United States Patent [19]

Ishihara et al.

[11] 4,352,875

[45] Oct. 5, 1982

[54] VOLTAGE DISTRIBUTION DIFFERENCE ELECTROPHOTOGRAPHIC PROCESS

[75] Inventors: Shunichi Ishihara, Kodaira; Yuji Nishigaki, Tokyo; Nobuo Kitajima, Toride; Nobuko Kitahara, Tama, all of Japan

[73] Assignee: Canon Kabushiki Kaisha, Tokyo, Japan

[21] Appl. No.: 228,723

[22] Filed: Jan. 27, 1981

[30] Foreign Application Priority Data

Feb. 5, 1980 [JP] Japan ..... 55-12684
Mar. 4, 1980 [JP] Japan ..... 55-27734

[51] Int. Cl.[3] ..... G03G 13/01

[52] U.S. Cl. ..... 430/42; 430/45; 430/47; 430/53; 355/4; 355/8

[58] Field of Search ..... 430/42, 55, 32, 44, 430/45, 47, 31, 35, 53; 355/4, 8

[56] References Cited

U.S. PATENT DOCUMENTS 3,457,070 7/1969 Watanabe et al. ..... 430/54

*Primary Examiner*—John D. Welsh
*Attorney, Agent, or Firm*—Fitzpatrick, Cella, Harper & Scinto

[57] ABSTRACT

Disclosed is an electrophotographic process comprises applying voltage between a transparent electrode and an opaque electrode of a photosensitive member comprising isolated electrically conductive members forming image elements, a photoconductive layer, transparent electrodes and opaque electrodes, imagewise exposing the side opposite the side where the isolated electrically conductive members are arranged, resulting in formation of voltage differences between the area where light passes through a transparent electrode and the area where light does not pass through the transparent electrode, said distribution voltage being a voltage between the transparent electrode and the isolated electrically conductive electrode and a voltage between the opaque electrode and the isolated electrically conductive electrode, thereby forming a voltage image depending upon the change of voltage of the isolated electrically conductive member produced corresponding to the difference in the distribution voltage, and scanning the electrophotographic photosensitive member within the area where imagewise exposure is carried out, or moving an image receiving member and an optical image projected on the electrophotographic photosensitive member in the relatively opposite direction, simultaneously with attaching a developer to the image receiving member based on an electric field produced by the voltage image.

In foregoing process, the imagewise exposure is carried out through a color filter, a color developer corresponding to the color light which passes through the transparent electrode is attached to the image receiving member based on an electric field produced by the voltage image. Said color filter comprises a red filter, a green filter, and a blue filter. Each of said color filters and each of said electrophotographic photosensitive members are assembled in one unit.

5 Claims, 10 Drawing Figures

VOLTAGE DISTRIBUTION DIFFERENCE ELECTROPHOTOGRAPHIC PROCESS

BACKGROUND OF THE INVENTION

1. Field of the Invention

This invention relates to an electrophotographic process for producing voltage images by utilizing differences in distribution voltage caused by a change resistance of a photoconductive layer in an electrophotographic photosensitive member.

2. Description of the Prior Art

There are known various electrophotographic processes. The most popular electrophotographic process is a process which comprises charging and imagewise exposure to produce electrostatic images.

In general, electrostatic images are produced by corona discharging to charge the surface of a photosensitive member and imagewise exposing to selectively dissipate the charge at the exposed portions. The electrostatic images are developed with a toner of a polarity opposite to that of the electrostatic images and the developed images are transferred to a receiving paper. Such an electrophotographic process needs wires and a shield case for effecting corona charging and high voltage for causing corona discharging so that it is difficult to obtain a compact apparatus for electrophotography.

On the contrary, some electrophotographic process capable of utilizing compact electrophotographic apparatuses have been proposed. Representative ones are disclosed in Japanese Patent Laid-open Nos. 68238/1973, 150342/1976, 1027/1978, 61534/1979 and 61537/1979. According to these processes, there can be produced voltage images capable of being developed with a charged toner without corona charging. That is, a voltage is applied to a photoconductive layer provided with electrodes to conduct imagewise exposure to cause differences in the distributed voltage between the exposed portions and the unexposed portions resulting in the formation of voltage images.

Photoconductive layers used for the photosensitive member where the voltage images are formed may be composed of the same material as that for photoconductive layers for conventional photosensitive members. Resolution of the formed images depends on the number of electrodes of the photosensitive member and isolated conductors per unit area. Therefore, there is a drawback that a photosensitive member having an area corresponding to the area of images to be copied and minute pattern electrodes and isolated conductors is difficult to manufacture.

According to conventional methods for forming color images using electrophotographic photosensitive members, it is necessary to expose the original color images three times and the exposure is conducted through color filters, in general, red, green and blue filters. In each of the three exposures, toner images are produced by means of a toner having a color which is a complementary color to the color of the filter. For example, a photosensitive member is charged and imagewise exposed through a red filter followed by developing with a cyan toner, and the images thus developed are transferred to an image receiving paper. And then the same procedure is conducted except that the red filter is replaced by a green filter and a blue filter and the cyan toner is replaced by a magenta toner and a yellow toner, respectively.

According to such a conventional electrophotographic method for forming color images, it is necessary to repeat the image forming procedure at least three times separately.

Therefore, toner images having different colors are transferred to a receiving paper in such a way that the toner images of one color overlie those of another color. It is very difficult to overlay the colors in register. It is required to clean completely the photosensitive member each time when one color toner is used. Otherwise, the three colors are mixed disturbing the formation of a sharp color image. For completely cleaning the photosensitive member, a complicated cleaning device is necessary resulting in a large electrophotographic apparatus. In addition, such complete cleaning results in shortening the life of the photosensitive member. Further, it takes a disadvantageously long time to repeat the color image formation three times.

SUMMARY OF THE INVENTION

It is a principal object of the present invention to provide an electrophotographic process having none of the foregoing drawbacks, and capable of using a photosensitive member which is not necessarily a surface corresponding to a surface of an image to be copied.

It is another object of the present invention to provide a full color image forming process in which all colors are in register, the time for color copying is short, and a cleaning process is not necessary.

According to an aspect of the present invention, there is provided an electrophotographic process which comprises: applying a voltage between a transparent electrode and an opaque electrode of an electrophotographic photosensitive member comprising isolated electrically conductive members forming image elements, a photoconductive layer, transparent electrodes and opaque electrodes, conducting imagewise exposure from the side opposite to the side where the isolated electrically conductive members are arranged, resulting in the formation of a difference with regard to the distribution voltage between the area where light passes through a transparent electrode and the area where light does not pass through the transparent electrode, said distribution voltage being a voltage distributed between the transparent electrode and the isolated electrically conductive electrode and a voltage distributed between the opaque electrode and the isolated electrically conductive electrode, thereby forming a voltage image depending upon the change voltage of the isolated electrically conductive member produced corresponding to the difference in the distribution voltage, and (a) scanning the electrophotographic photosensitive member within the area where imagewise exposure is carried out, or (b) moving an image receiving member and an optical image projected on the electrophotographic photosensitive member in the relatively opposite direction, simultaneous with attaching a developer to the image receiving member based on an electric field produced by the voltage image.

A process according to the present invention makes easy the manufacture of a photosensitive member, said process being capable of using a photosensitive member which is not necessarily a surface corresponding to a surface of an image to be copied, on the basis of scanning a photosensitive member within the area that imagewise exposure is carried out with developing, or scanning an image receiving member with developing.

According to another aspect of the present invention there is provided an electrophotographic process in which a full color image can be produced by a one time imagewise exposure, and which produces a full color image in register and free from color mixing.

DESCRIPTION OF THE PREFERRED EMBODIMENTS

Figure 1:
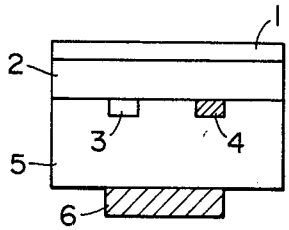
FIG. 1 illustrates an embodiment of the electrophotographic photosensitive member according to the present invention.

According to the present invention, there can be used a photosensitive member in a form of a stripe having a width of 3 cm or less, or a photosensitive member having a very narrow width in which isolated electrically conductive members are disposed in a line as shown in FIG. 1. In this example, if the clearance between a transparent electrode and an opaque electrode is a predetermined minute gap the, width of the electrodes are not required to be so minute. Accordingly, the electrodes can be easily prepared, and the resulting electrodes are strong and durable.

In the following, the present invention will be described in detail with reference to preferred embodiments shown in the accompanying drawings.

Figure 2:
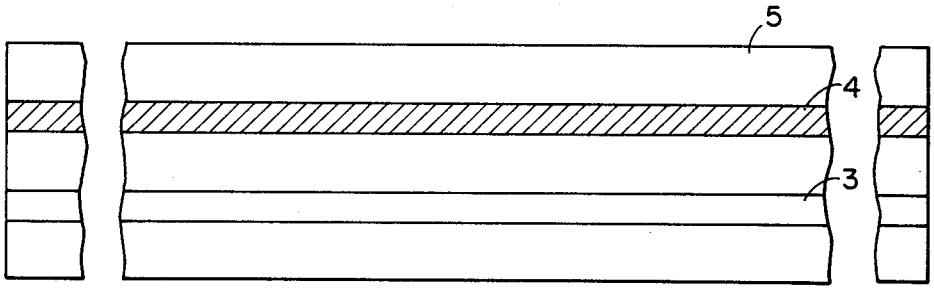
FIGS. 2 and 3 are a transverse sectional view and a plan view of the electrophotographic photosensitive member shown in FIG. 1, respectively.
Figure 3:
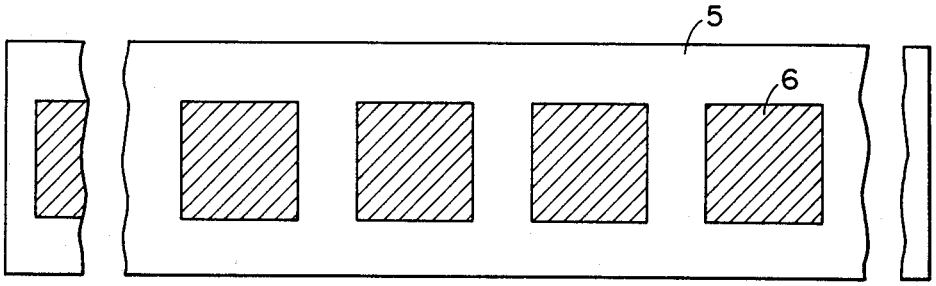

FIG. 1 shows a vertical section of a photosensitive member employed in the present invention. The photosensitive member is composed of color filter 1, transparent substrate 2, transparent electrode 3, opaque electrode 4, photoconductive layer 5, and isolated electrically conductive member 6. FIG. 2 shows a transverse cross section corresponding to photoconductive layer 5, transparent electrode 3, and opaque electrode 4. The electrode has the form of a stripe, respectively. As shown in FIG. 3, each isolated electrode is formed in an isolated state. In the case of forming a monochromatic image, a color filter may be absent.

For forming a color filter 1 on substrate 2, the same manner as in the production of conventional color filter may be acceptable. For example, a vapor deposition process and a coloring process are representative.

The vapor deposition method is used to make the color filter with an interference filter, wherein thin films, each having different refractive indices, are vapor deposited on the substrate through a mask in a plurality of laminated layers to a predetermined thickness so that only a desired wavelength region of light (color) may be transmitted by the interference effect of the light, thereby forming the color filter in red, green, blue, etc.

The coloring process comprises the following steps. To a substrate is applied a resin such as poly(vinyl alcohols), gelatin, polyurethanes, polycarbonates and the like to form a dye acceptable layer. Dyes are then added to the layer to form a filter layer.

Representative dyestuffs for use in the color filter according to the present invention are as follows.

(1) Acceptable sublimable red dyes: Celliton Scarlet B(supplied by BASF), Diacelliton Fast Pink R(supplied by Mitsubishi Chemical Industrial Ltd.), Terasil Brilliant Pink 4BN(supplied by Ciba-Geigy Ltd.), Kayalon Red R(supplied by Nippon Kayaku Co., Ltd.), Sumikaron Red E-FBL(supplied by Sumitomo Chemical Co., Ltd.), Resolin Red FB(supplied by Bayer AG.), Sumiacryl Rhodamine 6GCP(supplied by Sumitomo Chemical Co. Ltd.), Aizen Cathilon Pink FGH(supplied by Hodogaya Chemical Co., Ltd.), Maxilon Brilliant Red 4G(supplied by Ciba-Geigy Ltd.), Diacryl Supra Brilliant Pink R-N(supplied by Mitsubishi Chemical Industrial Ltd.), and the like.

Acceptable red dyes for application are: Suminol Fast Red B conc.(supplied by Sumitomo Chemical Co., Ltd.), Aizen Brilliant Scarlet 3 RH(supplied by Hodogaya Chemical Co., Ltd.), Azo Rubinol 3GS 250%(supplied by Mitsubishi Chemical Industrial Ltd.), Kayaku Acid Rhodamine FB(supplied by Nippon Kayaku Co., Ltd.), Acid Anthracene Red 3B(supplied by Chuhgai Chemical Co., Ltd.), Benzil Fast Red B(supplied by Ciba-Geigy Ltd.), Palatine Fast Red RN(supplied by BASF), Nylomine Red 2BS(supplied by I.C.I. Ltd.), Lanafast Red 2GL(supplied by Mitusi-Toatsu Chemicals Inc.), Rose Bengal(supplied by Kii Chemical Industry Ltd.) and the like.

(2) Acceptable sublimable green dyes are: Aizen Diamond Green GH(supplied by Hodogaya Chemical Co., Ltd.), Aizen Malachite Green(supplied by Hodogaya Chemical Co., Ltd.), Brilliant Green(supplied by E. I. du Pont de Nemours & Co., Inc.), Fast Green JJO(supplied by Ciba-Geigy Ltd.), Synacril Green G (supplied by I.C.I. Ltd.), Victoria Green(supplied by E. I. du Pont de Nemours & Co., Inc.) and the like.

Acceptable green dyes for application are: Kayakalan Blue-Black 3BL(supplied by Nippon Kayaku Co., Ltd.), Sumilan Green BL(supplied by Sumitomo Chemical Co., Ltd.), Aizen Floslan Olive Green GLH(supplied by Hodogaya Chemical Co., Ltd.), Diacid Cyanine Green GWA(supplied by Mitsubishi Chemical Industrial Ltd.), Cibalan Green GL(supplied by Ciba-Geigy Ltd.), Carbolan Brilliant Green 5G(supplied by I.C.I. Ltd.), Palatine Fast Green BLN(supplied by BASF), Acid Green GBH(supplied by Takaoka Chemical Co., Ltd.), Acid Brilliant Milling Green B(supplied by Mitsui-Toatsu Chemicals Inc.), and the like.

Also, green can be produced by the incorporation of blue and yellow-dyes.

(3) Acceptable sublimable blue dyes are: Miketon Fast Blue Extra(supplied by Mitsui-Toatsu Chemicals Inc.), Kayalon Fast Blue FN(supplied by Nippon Kayaku Co., Ltd.), Sumikaron Blue E-BR(supplied by Sumitomo Chemical Co., Ltd.), Terasil Blue 2R(supplied by Ciba-Geighy Ltd.), Palanil Blue R(supplied by BASF), Aizen Brilliant Basic Cyanine 6GH (supplied by Hodogaya Chemical Co., Ltd.), Aizen Cathilon Blue GLH(supplied by Hodogaya Chemical Co., Ltd.), Cibacet Blue F3R(supplied by Ciba-Geigy Ltd.), Diacelliton Fast Brilliant Blue B(supplied by Mitsubishi Chemical Industrial Co., Ltd.), Dispersol Blue BN(supplied by I.C.I. Ltd.), Resolin Blue FBL(supplied by Bayer A. G.) Latyl Blue FRN (supplied by E. I. du Pont de Nemours & Co., Inc.), Sevron Blue ER(supplied by E. I. du Pont de Nemours & Co., Ltd.), Diacryl Brilliant Blue H2R-N(supplied by Mitsubishi Chemical Industrial Co., Ltd.) and the like.

Acceptable blue dyes for application are: Orient Soluble Blue OBC(supplied by Orient Chemical Co., Ltd.), Suminol Leveling Blue 4GL(supplied by Sumitomo Chemical Co., Ltd.), Kayanol Blue N2G(supplied by Nippon Kayaku Co., Ltd.), Mitsui Alizarine Saphirol B(supplied by Mitsui-Toatsu Chemicals Inc.), Xylene Fast Blue BL 200%(supplied by Mitsubishi Chemical Industrial Co., Ltd.), Alizarine Fast Blue R(supplied by Ciba-Geigy Ltd.), Carbolan Brilliant Blue 2R(supplied by I.C.I. Ltd.), Palatine Fast Blue GGN(supplied by BASF), Aizen Opal New conc.(supplied by Hodogaya Chemical Co., Ltd.), Fastogen Blue SBL(supplied by Dainihon Ink Chemical Co., Ltd.) and the like.

A color filter is formed on a substrate as shown in FIG. 1, or alternatively, it may be directly formed on the surface of the photoconductive layer, transparent electrode, and opaque electrode. Also, it is not necessary that the color filter is formed on the whole surface of the photosensitive member, since the color filter may be selectively formed in an upper portion of the transparent electrode.

Substrate 2 is transparent, and made of glass, resin, and the like. The transparent electrode and opaque electrode may be made by various processes. A representative process is the chemical etching process in which vacuum evaporation and a photoresist are used. In this process, after a material forming a transparent electrode such as $In_2O_3$, $SnO_2$, and the like is deposited by vacuum evaporation, a masking pattern having a form of a stripe is formed by use of a photoresist. A layer of $In_2O_3$, and the line is selectively etched by use of a predetermined etching agent such as an acid or alkali, and the masking pattern of the photoresist is removed to form a transparent electrode. Also, an opaque electrode is formed in the same way as above. As a material for forming an opaque electrode, there are used metals such as Al, Ag, Pb, Zn, Ni, Au, Cr, Mo, Ir, Nb, Ta, U, Ti, Pt and the like.

Such metal is formed in a layer by vacuum evaporation, electro beam evaporation, sputtering evaporation, and the like.

Materials which are already generally used for photoresist can be used. For example, the following are commerically available: KPR(trade name, Kodak Photo Resist; supplied by Kodak . . . developer: methylene chloride, trichlene etc.), KMER(trade name, Kodak Metal Etch Resist; supplied by Kodak . . . developer: Xylene, trichlene etc.), TPR(trade name; supplied by Tokyo Ohka . . . developer: Xylene, trichlene etc.), Shipley AZ 1300(trade name; supplied by Shipley . . . developer: alkali aqueous solution), NTFR(trade name, Kodak Thin Film Resist; supplied by Kodak . . . developer: Xylene, trichlene etc.), FNRR(trade name; supplied by Fuji Yakuhin Kogyo Co., Ltd. . . . developer: Chlorcene), FPER(trade name, Fuji Photo Etching Resist; supplied by Fuji Photo Film Co., Ltd. . . . developer: trichlene), TESH DOOL(trade name; supplied by Okamoto Chemical Industrial Co., Ltd. . . . developer: water), Fuji-Resist No. 7(trade name; supplied by Fuji Yakuhin Kogyo Co., Ltd. . . . developer: water); and the like. Further, there are used trichlene, methylene chloride, AZ Remover(trade name; supplied by Shipley), sulfuric acid and the like for removing the used mask.

Formation of a transparent electrode and an opaque electrode may be done by vapor deposition of an electrode forming material on the substrate through a mask having therein a comb-shaped opening, followed by removal of the mask. Thickness of the transparent electrode usually ranges from 500 Å to 6,000 Å. Thickness of the opaque electrode usually ranges from 500 Å–2 microns.

The photoconductive layer 3 is formed by the vacuum deposition of an inorganic photoconductive material such as S, Se, PbO, Si or alloys and intermetallic compounds containing therein S, Se, Te, As, Sb, etc. When the sputtering method is used, a photoconductive substance having a high melting point such as ZnO, CdS, CdSe, $TiO_2$, and so on may be deposited on the substrate to form the photoconductive layer. In the case of forming the photoconductive layer by coating, there may be used various organic photoconductive materials such as polyvinyl carbazo, anthracene, phthalocyanine, and so forth, or such origanic photoconductive materials which have been color-sensitized or Lewis acid-sensitized, or a mixture of such organic photoconductive materials and an insulative binder. A mixture of inorganic photoconductive material such as ZnO, CdS, $TiO_2$, PbO, etc. and an insulative binder is also suited for the purpose. For the insulative binder, there may be used various sorts of resins. Thickness of the photoconductive layer, though it depends on the kind and characteristics of the photoconductive material to be used, may generally range from 5 to 100 microns, or more preferably from 10 to 50 microns or so.

Figure 4:
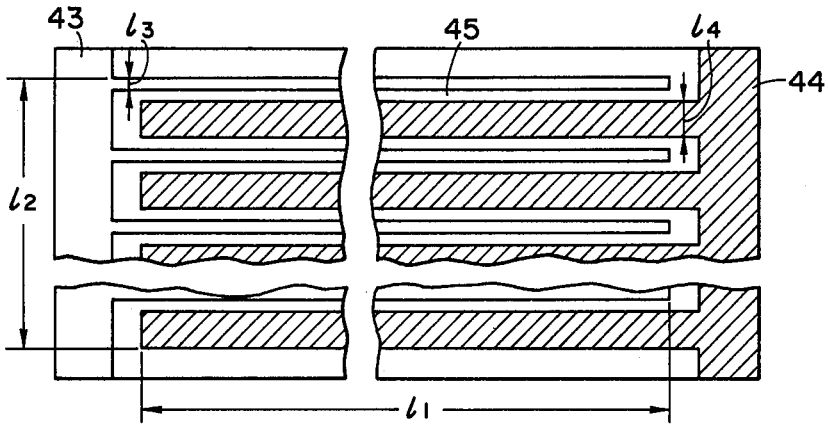
FIG. 4 shows another embodiment of the electrophotographic photosensitive member employed in the present invention.
Figure 5:
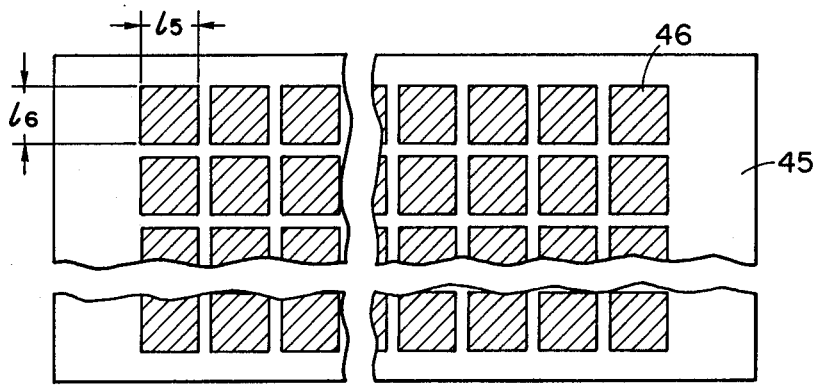
FIG. 5 is a view of the surface of the electrophotographic photosensitive member shown in FIG. 4.

It is not always necessary that isolated electrically conductive members 6 be disposed in a line as shown in FIG. 3. The isolated electrodes may be juxtaposed for any member of rows within a possible extent of manufacture. For example, transparent and opaque electrodes in pair, and the isolated electrodes may be assembled in any required numbers, as shown in FIGS. 4 and 5. FIG. 4 is a transverse cross section of photoconductive layer 45, transparent electrode 43, and opaque electrode 44. $l_1$ is about 300 mm, $l_2$ about 5 mm, $l_3$ of transparent electrode 43 10 microns, $l_4$ of opaque electrode 30 microns. In FIG. 5, $l_5$ and $l_6$ are 50 microns, respectively, at the side of isolated electrodes 46 is a photosensitive member.

Figure 6:
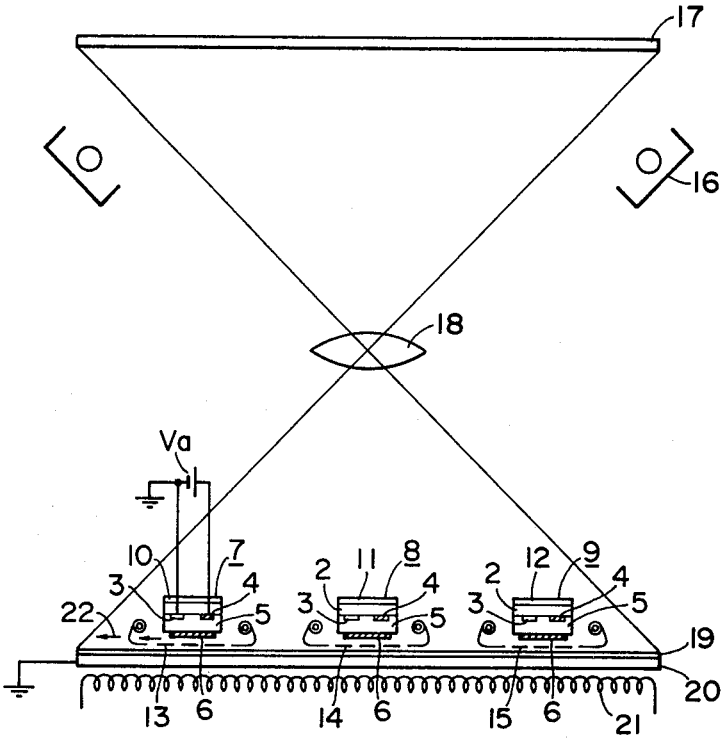
FIG. 6 shows an embodiment of the electrophotographic process according to the present invention.

FIG. 6 shows a representative process which forms a color image by use of the photosensitive member shown in FIG. 1. An image of original 17 is projected on image receiving member 19 such as paper, film and the like overlying an electrically conductive substrate(for example, a metallic plate) 20 by wide angle lens 18, the original being lighted by light source 16.

In this state, three types of the photoconductive member shown in FIG. 1 are scanned on image receiving member 19. In other words, photosensitive member 7 provided with red filter 10, photosensitive member 8 provided with green filter 11, and photosensitive member 9 provided with blue filter 12 are juxtaposed, and they are scanned in the direction of arrow 22 within the area where the image of the original is projected.

There are mesh screens 13, 14 and 15 containing developer between isolated electrically conductive member 6 of each photosensitive member and image receiving member 19, respectively. The mesh screens can move so that a fresh developer can be always supplied. The starting portion of the mesh screen is soaked in reservoirs for the developer. A dry developer or a wet developer may be used for developing.

Voltage Va is applied across transparent electrode 3 and opaque electrode 4, opaque electrode 4 being earthed. Electrically conductive substrate 20 present at the back side of the receiving member is also earthed. The potential of the isolated electrically conductive member on the photosensitive member depends upon whether the photoconductive layer present below the transparent electrode is lighted or not.

Forming a potential image on the isolated electrically conductive member and adhering of the developer to the image receiving member are simultaneously carried out.

Figure 7:
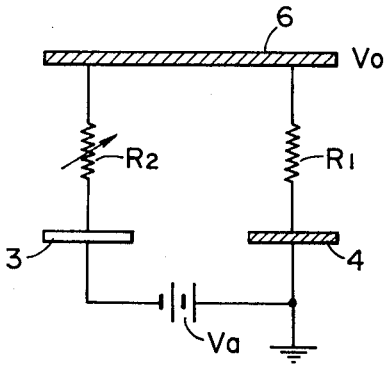
FIG. 7 is an equivalent circuit diagram of the electrophotographic photosensitive member according to the present invention.

In other words, FIG. 7 shows the equivalent circuit of the photosensitive member in the foregoing procedure.

$R_1$ represents a resistance between opaque electrode 4 and isolated electrically conductive member 6, and $R_2$ represents a resistance between isolated electrically conductive member 6 and transparent electrode 3. Potential $V_0$ is isolated electrically conductive member 6 is a distribution voltage across transparent electrode 3 and isolated electrically conductive member 6, and $V_0$ is represented by the following equation (1).

$$V_0 = \frac{R_1}{R_1 + R_2} Va \quad (1)$$

When imagewise exposure is effected from the side of color filters when a voltage Va is applied, a difference of potential in isolated electrically conductive members is generated between the isolated electrically conductive members corresponding to the area where light passes through the transparent electrode and the members corresponding to the area where light does not pass through the transparent electrode. In a photosensitive member corresponding to the area where light passes through the transparent electrode, $R_1$, the resistance between an opaque electrode and an isolated electrically conductive member is unchanged since projected light can not reach the photoconductive layer in the portion where the member is shielded from the light by the opaque electrode. On the contrary, $R_2$, the resistance between a transparent electrode and an isolated electrically conductive member decreases since an irradiated light can reach the photoconductive layer through the transparent electrode. Equation (1) can be changed to the following equation (2). When resistance $R_2$ decreases, the potential of the isolated electrically conductive member increases as shown directly by equation (2).

$$V_0 = \frac{1}{R_2/R_1 + 1} Va \quad (2)$$

On the contrary, in a photosensitive member corresponding to the portion where light can not pass through the transparent electrode, the potential of the isolated electrically conductive member is unchanged since $R_1$ and $R_2$ are unchanged. Consequently, a potential image is formed due to the fact that the potential of the isolated electrically conductive member at the portion where the projected light passes through the transparent electrode becomes higher than that at the portion where the irradiated light can not pass through the transparent electrode. For example, if $R_2$ decreases by an order of three or more in the portion where the projected light can pass through the transparent electrode, $R_2/R_1$ becomes nearly zero and $V_0$ becomes nearly equal to Va. In this case, since $R_2$ is nearly equal to $R_1$ in the portion where the projected light can not pass through the transparent electrode, $V_0$ becomes nearly equal to ½ Va. Under these conditions, the following table shows the relationship between each color portion of an original bearing a color image and a potential of each isolated electrically conductive member in photosensitive members 7, 8 and 9 provided with a red filter, a green filter, and a blue filter, respectively, said potential being generated corresponding to each color portion of the original. A cyan toner is attached to an image receiving member by the photosensitive member provided with the red filter, a magneta toner to the image receiving member by the photosensitive member provided with the green filter, and a yellow toner to the image receiving member by the photosensitive member provided with the blue filter.

TABLE 1

| Color of original | photo-sensitive member | | |
|---|---|---|---|
| | Red filter | Green filter | Blue filter |
| Black | ½ Va Cyan toner attaches | ½ Va Magenta toner attaches | ½ Va Yellow toner attaches |
| White | Va | Va | Va |
| Red | Va | ½ Va Magenta toner attaches | ½ Va Yellow toner attaches |
| Green | ½ Va Cyan toner attaches | Va | ½ Va Yellow toner attaches |
| Blue | ½ Va Cyan toner attaches | ½ Va Magenta toner attaches | Va |

Attaching of the toner to the image receiving member in the photosensitive member provided with the red filter is carried out in the following manner: an electric field does not generate between the electrically conductive substrate and an isolated electrically conductive member corresponding to a white portion and red portion of an original, however electric fields generate between electrically conductive substrates and isolated electrically conductive members corresponding to color portions other than red. Therefore, if a cyan toner having the same polarity as that of Va is supplied, the toner is retained on the mesh screen without transferring from the mesh screen to the image receiving member at the portion corresponding to white and red portions of the original, however the toner transfers to the image receiving member at the portions corresponding to color portions other than red. The toner thus transferred to the image receiving member is melted so that a toner image is fixed, since the image receiving member is heated by heater 21 up to the melting point of the toner.

Successively, photosensitive members having a green filter and a blue filter, respectively, are scanned, then developing and fixing are carried out by a magenta toner and a yellow toner having the same polarity as that of Va. Thereby, a full color image corresponding to the original image is produced according to the above table.

A voltage slightly lower than Va(higher than ½ Va) and having the same polarity as that of Va may be applied to the electrically conductive substrate instead of earthing to prevent fog and so. The potential of the isolated electrically conductive member is suitably varied depending upon a concrete difference of construction in the transparent electrode and the opaque electrode, magnitude of the applied potential or characteristics of the photoconductive layer, in the allowable range centered at ½ Va or Va. With regard to polarity, a potential having the polarity opposite to that listed in the above table can be generated at the isolated electrically conductive member by earthing the side of the transparent electrode. In this case, a full color image corresponding to the original image can be produced by reversing the polarity of the toners. For improving the quality of a color image, especially for reproducing clearly a black portion of an original, it is effective that a black toner is attached to an image receiving member by a photosensitive member without a color filter.

As another embodiment according to the present invention, a color filter is separated from a photosensitive member, and the color filter and the photosensitive member may be simultaneously scanned. In this case, a full color image can be produced in such manner that, for example, three times scanning of one photosensitive member is repeated with one color filter (one of the foregoing three color filters) used during each scanning.

The already described procedures are processes for producing a full color image, on the contrary a monochromic image can be produced by use of a photosensitive member without a color filter, and by developing with scanning of the photosensitive member within an area where an image of an original is projected. For producing such monochromic image, only one photosensitive member can be used.

In the present invention, "transparent" is intended to be transparent with respect to the imagewise exposure, and "opaque" to be non-transparent with respect to the imagewise exposure, that is, they are not restricted to being visually transparent or non-transparent.

Figure 8:
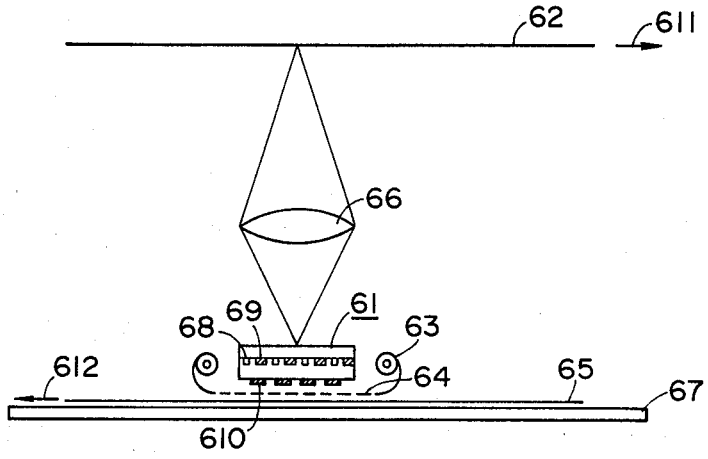
FIG. 8 shows still another embodiment according to the present invention.

FIG. 8 shows a representative process which forms an image by use of photosensitive members shown in FIGS. 4 and 5. An image or original 62 is focused on photosensitive member 61 through lens 66. Mesh screen 64 containing developer is present between image receiving member 65 such a paper, film, and the like, and photosensitive member 61. Fresh developer is always supplied to the mesh screen by developer supplying portion 63. Developing electrode 67 is disposed on the side of image receiving member 65 opposite to mesh screen 64.

Va is applied across transparent electrode 68 and opaque electrode 69, and Vb is applied to developing electrode 67. Vb is suitably selected in accordance with an image state dependent on a type of developer and a potential of isolated electrically conductive member. Image receiving member 65 is moved in the direction of arrow 612, and original 62 in the direction of arrow 611. As shown in a usual electrophotographic copying machine, the following procedure may be carried out such that that an original is fixed, and that an optical image projected on a photosensitive member is moved by moving of an optical system to produce the optical image on the photosensitive member. The image of original 62 is projected on image receiving member 65 by a procedure whereby original 62 and image receiving member 65 are moved in the opposite direction to each other.

Figure 9:
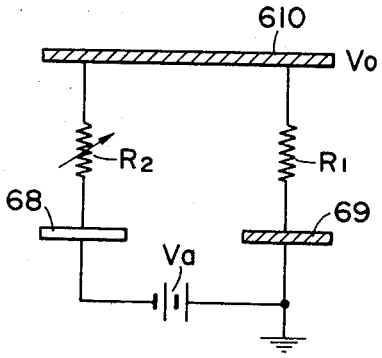
FIG. 9 shows an equivalent circuit of the electrophotographic photosensitive member of FIG. 8.

In other words, FIG. 9 shows the equivalent circuit of this photosensitive member.

$R_1$ represents a resistance between opaque electrode 69 and isolated electrically conductive member 610, and $R_2$ represents a resistance between isolated electrically conductive member 610 and transparent electrode 68. Potential $V_0$ at isolated electrically conductive member 610 is a distribution voltage across transparent electrode 68 and isolated electrically conductive member 69, and $V_0$ is represented by the following equation (1).

$$V_0 = \frac{R_1}{R_1 + R_2} Va \quad (1)$$

When imagewise exposure is effected from the side of the color filters and a voltage Va is applied, a difference of potential in isolated electrically conductive members is generated between the isolated electrically conductive members corresponding to the area where light passes through the transparent electrode and the members corresponding to the area where light does not pass through the transparent electrode. In the photosensitive member corresponding to the area where light passes through the transparent electrode, $R_1$, the resistance between an opaque electrode and an isolated electrically conductive member is unchanged since projected light can not reach the photoconductive layer in the portion where the number is shielded from the light by the opaque electrode. On the contrary, $R_2$, the resistance between a transparent electrode and an isolated electrically conductive member decreases since an irradiated light can reach the photoconductive layer through the transparent electrode. Equation (1) can be changed to the following equation (2). When resistance $R_2$ decreases, the potential of the isolated electrically conductive member increases as shown directly by equation (2).

$$V_0 = \frac{1}{R_2/R_1 + 1} Va \quad (2)$$

On the contrary, in a photosensitive member corresponding to the portion where light can not pass through the transparent electrode, the potential of the isolated electrically conductive member is unchanged since $R_1$ and $R_2$ are unchanged. Consequently, a potential image is formed due to the fact that the potential of the isolated electrically conductive member at the potion where the projected light passes through the transparent electrode becomes higher than that at the portion where the irradiated light can not pass through the transparent electrode. For example, if $R_2$ decreases by an order of three or more in the portion where the projected light can pass through the transparent electrode, $R_2/R_1$ becomes nearly zero and $V_0$ beomces nearly equal to Va. In this case, since $R_2$ is nearly equal to $R_1$ in the portion where the projected light can not pass through the transparent electrode, $V_0$ becomes nearly equal to ½ Va.

Figure 10:
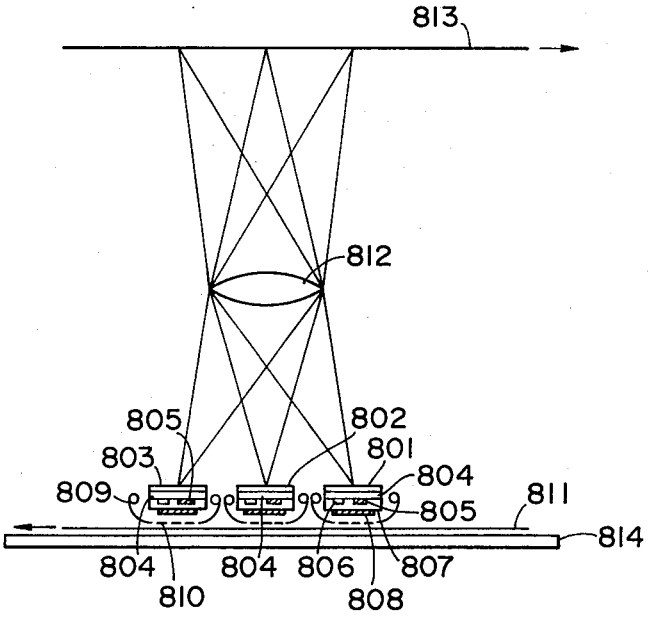
FIG. 10 shows another embodiment of the electrophotographic process according to the present invention.

FIG. 10 shows a embodiment for forming a full color image. The embodiment is basically same as that shown in FIG. 8, however the embodiment shown in FIG. 10 is different from that shown in FIG. 8 in that a full color image is produced by a singular imagewise exposure based on disposing three sets of photosensitive members. Reference numeral 805 represents an opaque electrode, 806 a transparent electrode, and 807 a photoconductive layer. Color filters 801, 802 and 803 are disposed on substrates 804 of the photosensitive members.

The same relationship as shown in Table 1 is obtained with regard to a relationship between each color portion of an original having a color image and a potential of each isolated electrically conductive member corresponding to red filter 801, green filter 802, and blue filter 803, respectively.

A toner of a developer attached to the image receiving member by the photosensitive member provided with the red filter is cyan, a toner attached to the image receiving member by the photosensitive member provided with the green filter is magenta, and a toner attached to the image receiving member by the photosensitive member provided with the blue filter is yellow.

Attachment of the toner to the image receiving member in the photosensitive member provided with the red filter is carried out in the following manner: an electric field does not generate between the electrically conductive substrate and an isolated electrically conductive member corresponding to a white portion and red portion of an original, however electric fields generate between electrically conductive substrates and isolated electrically conductive members corresponding to color portions other than red. Therefore, if a cyan toner having the same polarity as that of Va is supplied, the toner is retained on the mesh screen without transferring from the mesh screen to the image receiving member at the portion corresponding to white and red portions of the original, however the toner transfers to the image receiving member at the portions corresponding to color portions other than red. The toner thus transferred to the image receiving member is melted so that a toner image is fixed, since the image receiving member is heated by a heater up to the melting point of the toner.

Successively, the foregoing portion of the image receiving member is moved below photosensitive members having a green filter and a blue filter, respectively, then developing and fixing are carried out using a magenta toner and a yellow toner having the same polarity as that of Va. Thereby, a full color image corresponding to the original image is produced according to the above table.

A voltage slightly lower than Va (higher than $\frac{1}{2}$ Va) and having the same polarity as that of Va may be applied to developing electrode 814 instead of earthing to prevent fog and so. The potential of the isolated electrically conductive member is suitably varied depending upon a concrete difference of construction in the transparent electrode and the opaque electrode, magnitude of the applied potential or characteristics of the photoconductive layer, in the allowable range centered at $\frac{1}{2}$ Va or Va. With regard to polarity, a potential having the polarity opposite to that listed in the above table can be generated at the isolated electrically conductive member by earthing the side of the transparent electrode. In this case, a full color image corresponding to the original image can be produced by reversing the polarity of the toners. For improving the quality of a color image, especially for reproducing clearly a black portion of an original, it is effective that a black toner is attached to an image receiving member by a photosensitive member without a color filter.

EXAMPLE

On an optically transparent glass (30 cm×1 cm) was lengthways deposited a stripe of an opaque electrode of chromium by vacuum evaporation by the use of a mask. The obtained electrode was 3000 Å in thickness, 30 microns in width, and 30 cm in length. Subsequently, indium oxide was deposited by sputtering in oxygen gas atmosphere at a portion spaced 50 microns apart from the stripe of chromium by the use of a mask. The obtained transparent electrode was 1000 Å in thickness, 25 microns in width, and 30 cm in length. An amorphous silicon layer of about 10 microns in thickness was deposited on the glass having the electrodes by glow discharge of 13.56 MHz in a flow of $SiH_4$ gas. And isolated electrically conductive members of Au of 3000 Å thickness were deposited by vacuum deposition by a mask method, in such a way that each isolated electrically conductive member was 200 micron×200 micron, lengthwise arranged in the interval of 100 microns, and overlapped with the chromium stripe and the transparent electrode stripe.

Four photosensitive members were produced by the foregoing procedure. With regard to three of the photosensitive members, onto the glass substrate was applied an aqueous solution of dissolved gelatin, and red dye, green dye, or blue dye in a thickness of about ten microns to produce a color filter. A mesh having hole diameters of 100 microns was placed in the front of the thus prepared photosensitive member. On the mesh was smeared a ⊕ charged toner of cyan color (for a photosensitive member having a red filter), a ⊕ charged toner of magenta color (for a photosensitive member having a green filter), a ⊕ charged toner of yellow color (for a photosensitive member having a blue filter), or a ⊕ charged toner of black (for a photosensitive member without a color filter), respectively. The mesh was rolled at the ends thereof, so that a portion of the mesh having fresh toner was below the photosensitive member, if necessary.

These photosensitive members were scanned on a paper overlying a metalic plate. There was a heater inside the metalic plate, and the plate was heated by the heater so that a toner attached to the paper was melted and fixed on the paper.

The clearance between the paper and the mesh having the toner to cover the photosensitive member was controlled by a spacer to 100 microns.

200 V was applied between an opaque electrode stripe (stripe of chromium) and a transparent electrode stripe (the side of the opaque electrode stripe was earthed) of each photosensitive member. Thereafter, with the metallic plate earthed, a color image was projected from the side of the color filter of the photosensitive member, and the photosensitive member was moved from one end of the projected image to the other at a velocity of 10 cm/sec. to form a full color image corresponding to the original.

What we claim is:

1. An electrophotographic process which comprises: applying voltage between a transparent electrode and an opaque electrode of an electrophotographic photosensitive member comprising isolated electrically conductive members forming image elements, a photoconductive layer, transparent electrodes and opaque electrodes, conducting imagewise exposure from the side opposite to the side where the isolated electrically conductive members are arranged, resulting in the formation of differences with regard to a distribution voltage between the area where light passes through a transparent electrode and the area where light does not pass through the transparent electrode, said distribution voltage being a voltage distributed between the transparent electrode and the isolated electrically conductive electrode and a voltage distributed between the opaque electrode and the isolated electrically conductive member thereby forming a voltage image depending upon the change of voltage of the isolated electrically conductive member produced corresponding to the difference in the distribution voltage, and (a) scanning the electrophotographic photosensitive member within the area where imagewise exposure is carried out, or (b) moving an image receiving member and an optical image projected on the electrophotographic photosensitive member in relatively opposite directions, simultaneously with the attachment of a developer to the image receiving member based on an electric field produced by the voltage image.

2. An electrophotographic process according to claim 1 in which a developer is held on a mesh screen.

3. An electrophotographic process which comprises:

applying voltage between a transparent electrode and an opaque electrode of an electrophotographic photosensitive member comprising isolated electrically conductive members forming image elements, a photoconductive layer, transparent electrodes and opaque electrodes, conducting imagewise exposure through a color filter from the side opposite to the side where the isolated electrically conductive members are arranged, resulting in the formation of differences with regard to a distribution voltage between the area where light passes through a transparent electrode and the area where light does not pass through the transparent electrode, said distribution voltage being a voltage distributed between the transparent electrode and the isolated electrically conductive electrode and a voltage distributed between the opaque electrode and the isolated electrically conductive electrode, thereby forming a voltage image depending upon the change of voltage of the isolated electrically conductive member produced corresponding to the difference in the distribution voltage, and (a) scanning the electrophotographic photosensitive member within the area where imagewise exposure is carried out, or (b) moving an image receiving member and an optical image projected on the electrophotographic photosensitive member in relatively opposite directions, simultaneously with the attachment of a color developer corresponding to the color of light which passes through the transparent electrode to the image receiving member based on an electric field produced by the voltage image.

4. An electrophotographic process according to claim 3 in which said color filter comprises a red filter, a green filter, and a blue filter.

5. An electrophotographic process according to claim 3 in which each of said color filters and each of said electrophotographic photosensitive members are assembled in one unit.

* * * * *

UNITED STATES PATENT AND TRADEMARK OFFICE

CERTIFICATE OF CORRECTION

PATENT NO. : 4,352,875

DATED : October 5, 1982

INVENTOR(S) : SHUNICHI ISHIHARA, ET AL.

It is certified that error appears in the above-identified patent and that said Letters Patent is hereby corrected as shown below:

Column 1, line 9, after "change" insert --in--.

Column 2, line 50, after "change" insert --in--.

Column 3, line 43, after "gap" insert --,--; delete "," after "the";
line 48, after "to" insert --the--.

Column 4, line 66, "Geighy" should read --Geigy--.

Column 6, line 58, "photoconductive" should read --photosensitive--.

Column 7, line 25, before "isolated", change "is" to --at--.

Column 8, line 18, "magneta" should read --magenta--.

Column 9, line 45, "or" should read --of--;
line 48, "such a paper" should read --such as paper--;
line 63, after "such" delete "that".

Column 10, line 31, "number" should read --member--;
lines 51/52, "potion" should read --portion--;
line 58, "beomces" should read --becomes--.

UNITED STATES PATENT AND TRADEMARK OFFICE

CERTIFICATE OF CORRECTION

PATENT NO. : 4,352,875

DATED : October 5, 1982

INVENTOR(S) : SHUNICHI ISHIHARA, ET AL.

It is certified that error appears in the above-identified patent and that said Letters Patent is hereby corrected as shown below:

Column 12, line 42, "metalic" should read --metallic--;
line 43, "metalic" should read --metallic--.

Signed and Sealed this

*Twenty-first* Day of *June 1983*

[SEAL]

*Attest:*

DONALD J. QUIGG

*Attesting Officer*

*Acting Commissioner of Patents and Trademarks*